United States Patent [19]

Hayduchok

[11] 4,009,802

[45] Mar. 1, 1977

[54] PAINT CAN ATTACHMENT

[76] Inventor: Leon Hayduchok, 15 Sandy Lane, Trenton, N.J. 08610

[22] Filed: Sept. 2, 1975

[21] Appl. No.: 609,425

[52] U.S. Cl. ..... 222/108

[51] Int. Cl.[2] ..... B67D 1/16

[58] Field of Search ..... 222/569–571, 222/108–111, 192

[56] References Cited

UNITED STATES PATENTS

| | | | |
|---|---|---|---|
| 2,332,539 | 10/1943 | Taylor | 222/109 |
| 2,633,845 | 4/1953 | Peretti | 222/108 X |
| 3,844,457 | 10/1974 | Smart | 222/570 |
| 3,853,249 | 12/1974 | Weir, Jr. | 222/570 |

*Primary Examiner*—Stanley H. Tollberg
*Assistant Examiner*—Norman L. Stack, Jr.
*Attorney, Agent, or Firm*—Martha G. Pugh

[57] ABSTRACT

A semiannular paint can attachment combines brush scraping means with a shallow cavity for catching and retaining the paint drippings up to a certain level, above which the excess returns to the can through an internal opening. A pouring lip partially surrounds the opening, functioning in a dual capacity as a scraper for the brush, and to prevent paint poured from the can from dripping over the sides of the can.

6 Claims, 4 Drawing Figures

PAINT CAN ATTACHMENT

BACKGROUND OF THE INVENTION

This relates in general to attachments for the rim of a paint can, more particularly, of a type designed to eliminate or substantially reduce drippings from the side of the can while simultaneously retaining a shallow reservoir of paint.

Both amateur and professional painters have difficulty, during a painting operation when the brush is scraped against the side of the can, in preventing paint from leaking off of the brush and down the sides of the paint can. A more particular problem is that paint tends to fill up the grooves around the rim of the can, so that when the lid is applied, the paint hardens, making the lid difficult to remove. Moreover, it is desirable during the painting operation for the painter to have someplace to temporarily place the brush, and also to be able to collect sufficient paint for delicate trim operations without the necessity of dipping the brush down into the can. Furthermore, it is often necessary to pour paint from one can into another without spilling paint onto the sides of either can or onto the surrounding area.

Many prior art devices are constructed to perform one or more of these functions; but not to combine them.

SUMMARY OF THE INVENTION

Accordingly, it is the primary object of the present invention to provide an attachment for the rim of a paint can which combines the functions of protecting the rim and sides of the can from drippings and spillage while simultaneously providing a shallow reservoir of paint and a pouring spout for the paint.

This primary object and other objects are attained in accordance with the present invention in a semiannular attachment of plastic or the like which fits over and fastens onto the rim of the can, and which provides scraping edges for the brush whereby the excess paint is leaked into a small internal reservoir. The latter is downwardly sloped from the rim, having its maximum depth partway between the rim and the scraping edge. A small opening is provided extending circumferentially, just under the rim, so that when the paint in the reservoir rises to a preselected level, the excess flows back into the can. A lip is provided along the upper edge of the opening which has a dual function of providing additional scraping means for the brush and acting as a spout when paint is poured from one can into another.

These and other objects, features and advantages are described in detail with reference to the attached drawings.

DETAILED DESCRIPTION

Figure 1:
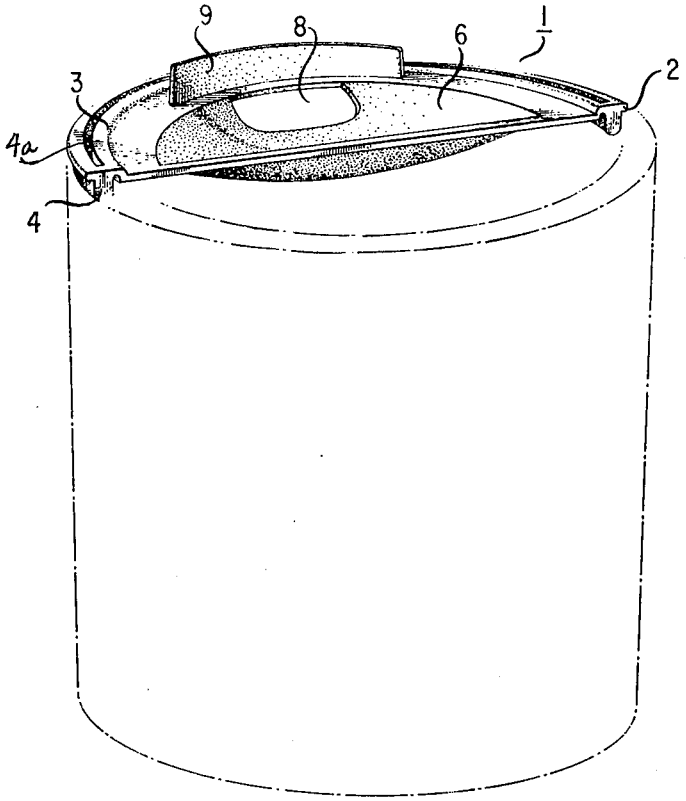
FIG. 1 of the drawings shows the paint can attachment of the present invention mounted on a typical paint can.

In FIG. 1 of the drawings the paint can attachment of the present invention is shown mounted on the friction groove of a typical paint can from which the lid has been removed. The attachment of the present invention is constructed to function simultaneously as a paintbrush holder and paint tray with an integral paint well, paint scraping means and pouring spout.

Figure 2:
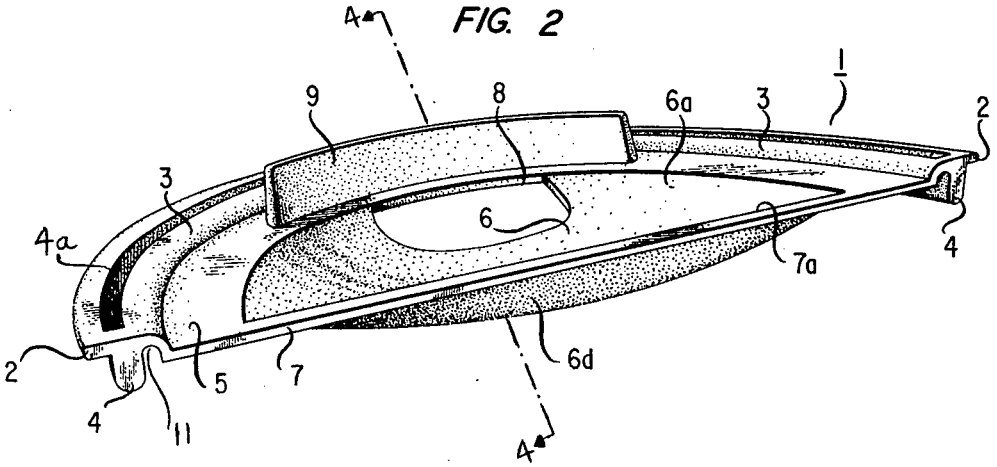
FIG. 2 is a perspective view from above of the paint can attachment of the present invention, separated from the can.

FIG. 2 of the drawings is a view of the paint can attachment 1 of the present invention looking in from the top. In the present embodiment, the attachment of the present invention is pressure molded from a sheet of polypropylene, ranging from about ⅛ to 3/16 inch in thickness, although it will be understood that any sufficiently rigid plastic material can also be used for this purpose. Preferably the material should have a modulus of elasticity of 1.6 to 2.5 × $10^5$ pounds per square inch. It is also contemplated that other materials, such as a thin sheet of metal, wood or even papier-mache, could be used for the purpose of the present invention.

The embodiment under description is semicircular, having a diameter of 6¼ inches, the outline of the circle being defined by a peripheral flange 2 which extends 1/16 inch out from the edge and protrudes about ⅛ inch below the top, which comprises a flat annular plane ⅛ inch wide. A semiannular recess 4*a*, which is about ⅛ inch wide and 5/16 inch deep, separates peripheral flange 2 from a rounded inner bead 3. The latter has an outer diameter of 5⅝ inches and an inner diameter of 5⅜ inches, with the curvature of the bead being roughly ⅛ inch radius, so that bead 3 is roughly ¼ inch across the upper side. Bead 3 surrounds a flat semiannular plane 5 which is about ⅜ inch wide in a radial direction. The diameter of the semicircular attachment 1 is outlined by a scraping edge 7, about 1/16 inch thick, comprising a narrow ledge 7*a*, about ⅛ inch wide in a horizontal plane.

Figure 3:
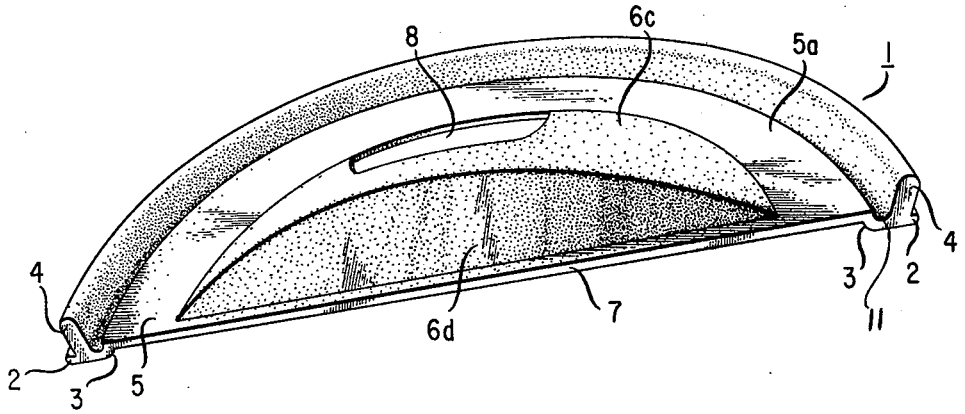
FIG. 3 is a view, in perspective, of the underside of the paint can attachment of FIG. 2.
Figure 4:
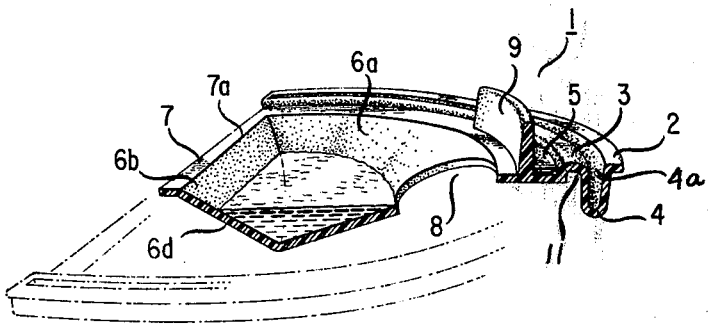
FIG. 4 is an enlarged sectional showing through the plane indicated by arrows 4—4 of FIG. 2.

Looking at the underside of the attachment 1 which is shown more clearly in FIGS. 3 and 4, coinciding with the underside of recess 4*a*, one sees a downwardly projecting semiannular flange 4 which is 6½ inches in outer diameter and 5¾ inches in inner diameter and extends down 7/16 inch from the horizontal plane of flat topped flange 2. Downwardly projecting flange 4 is rounded on the bottom, having a semicircular cross-section with a radius of about 3/16 inch. On the inside rim of flange 4, the underside of bead 3 forms, with the underside of plane 5, an annular semicircular hooked recess 11 about ⅛ inch in a radial direction.

Returning to FIG. 2, which shows the upper face of the attachment 1, semiannular plane 5 and ledge 7*a* define between them the recessed paint well 6, which is also semicircular, being 4½ inches across at its inner diameter and having a maximum radial width of about 2⅛ inches. The outer wall 6*a* of the well 6 declines from semiannular plane 5, forming an interior semiconical surface which makes an angle of, say, 20° with the horizontal. At the bottom of the recess this joins with the other wall surface 6*b*, which declines from the ledge 7*a* at an angle of approximately 60° with the horizontal. The two surfaces form between them a semicircular junction having an angle in the vertical plane of, say, 100°, creating a shallow receptacle about ¾ inch deep, as measured from plane 5. (See FIG. 4)

Centered near the upper edge of wall 6*a* is an elongated elliptical opening 8, about 1⅜ inches long and ½ inch in maximum width.

Disposed symmetrically along the upper side of opening 8 is a slightly curved lip 9, about 3⅜ inches around the periphery and ½ inch high, the base being centered concentrically along plane 5. It will be understood that the lip 9 may either be an integrally formed part of the attachment 1; or alternatively, it may be a separately formed detachable item, so formed as to snap into the groove 4*a*.

The relationship of the structure described is more clearly shown in the sectional view in FIG. 4.

OPERATION

Referring again to FIG. 1, which shows the attachment of the present invention in operating position, it is seen that the recess 11 is designed to snap over and engage the friction groove of the paint can after the cover has been removed. To implement this function, the plastic material from which the present embodiment is manufactured is preferably resilient.

During the painting operation the friction groove of the can is covered so that the paint does not get into the groove when the brush is being scraped, either on the edge 7 or the lip 9. Drippings from the brush fill up the well 6 to a depth of a little less than an inch, so that a small amount of paint is available for trim operations. The brush is conveniently rested with the tip in the well 6 and the handle resting against the rim flange 2 or the lip 9, so that excess paint flows back into the can through opening 8. Moreover, since the attachment 1 is designed to adhere tightly to the top of the can, the lip 9 readily functions as a spout when paint is poured from one can to another, keeping paint off the sides of the can.

It will be understood that the invention is not limited to the particular form or dimensions disclosed by way of illustration, but only by the scope of the appended claims.

What is claimed is:

1. A semicircular attachment for the open mouth of a paint can which comprises in combination:

a peripheral flange constructed and arranged to fit over and engage the edge of the can, the internal straight edge of said attachment connected between inner edges of said flange and forming a narrow scraping ledge, a paint well laterally enclosed between said peripheral flange and said narrow scraping ledge, and substantially depressed below the horizontal plane of said ledge, said well having an opening in the lateral wall on the side opposite said ledge at a level substantially above the bottom of said well, and a curved lip disposed between the upper edge of said opening and the inner edge of said flange.

2. A semicircular attachment in accordance with claim 1 for the open mouth of a paint can which comprises in combination:

a peripheral flange constructed and arranged to engage the edge of a conventional paint can comprising an outer rim and an inner rim spaced apart by a conventional annular friction groove, wherein the peripheral flange of said attachment comprises a downwardly depending semiannular flange which fits into the friction groove of said can, and an semiannular recess on the lower face of said attachment adjacent the interior of said depending annular flange which is constructed and arranged to fit over the inner rim of said paint can to secure said attachment on said can.

3. The combination in accordance with claim 1 wherein said paint well comprises a semiannular junction of two walls, forming between them an internal angle exceeding 90° in a principal cross-sectional plane through said attachment.

4. The combination in accordance with claim 3 wherein the wall declining from said ledge forms an internal angle with the principal horizontal plane of said ledge which is at least about twice the internal angle formed by the other said wall and a parallel horizontal plane.

5. The combination in accordance with claim 2 wherein said opening is substantially elliptical in form, elongated in a direction around the periphery of said attachment, and the ends of said curved lip extend beyond and are symmetrically disposed relative to the ends of said opening, forming with said well a spout for pouring from said can through said opening into another vessel.

6. A semicircular attachment in accordance with claim 5, whereby said downwardly depending semiannular flange forms a semiannular groove on the upper face of said attachment, and said curved lip is detachable, being constructed and arranged to seat in secured relation to said groove.

* * * * *